US009816504B2

(12) United States Patent
Cho et al.

(10) Patent No.: US 9,816,504 B2
(45) Date of Patent: Nov. 14, 2017

(54) SCROLL COMPRESSOR

(71) Applicant: SAMSUNG ELECTRONICS CO., LTD., Suwon-si, Gyeonggi-do (KR)

(72) Inventors: Yang Hee Cho, Seoul (KR); Moo Seong Bae, Osan-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 176 days.

(21) Appl. No.: 14/591,225

(22) Filed: Jan. 7, 2015

(65) Prior Publication Data

US 2015/0204330 A1 Jul. 23, 2015

(30) Foreign Application Priority Data

Jan. 23, 2014 (KR) ..... 10-2014-0008237

(51) Int. Cl.

| | |
|---|---|
| ***F01C 21/18*** | (2006.01) |
| ***F04C 2/063*** | (2006.01) |
| ***F01C 1/063*** | (2006.01) |
| ***F03C 2/30*** | (2006.01) |
| ***F04C 18/063*** | (2006.01) |
| ***F04C 18/02*** | (2006.01) |
| *F04C 29/02* | (2006.01) |

(52) U.S. Cl.
CPC ..... *F04C 18/0215* (2013.01); *F04C 18/0269* (2013.01); *F04C 29/02* (2013.01)

(58) Field of Classification Search
CPC ..... F04C 18/284; F04C 18/269
USPC ..... 418/150, 55.1, 55.2
See application file for complete search history.

(56) References Cited

U.S. PATENT DOCUMENTS 5,056,336 A * 10/1991 Harrison ..... F04C 18/0215 418/55.2
5,427,512 A * 6/1995 Kohsokabe ..... F01C 1/0246 418/150
6,152,713 A * 11/2000 Hisanaga ..... F04C 18/0215 418/14

* cited by examiner

*Primary Examiner* — Mark Laurenzi
*Assistant Examiner* — Deming Wan
(74) *Attorney, Agent, or Firm* — Staas & Halsey LLP

(57) ABSTRACT

Provided is a scroll compressor having an improved structure in which reliability of a compression portion can be enhanced. The scroll compressor includes a compression unit that compresses a refrigerant introduced into a body, wherein the compression unit may include: a fixed scroll fixed into the body and having an ejection hole and a fixed wrap placed at an outside of the ejection hole; and an orbiting scroll orbiting with respect to the fixed scroll and having an orbiting wrap that constitutes a compression chamber together with the fixed wrap, and wherein the orbiting wrap may include: an outer contact portion formed at an outside surface of the orbiting wrap and being adjacent to the ejection hole; and an inner contact portion formed at an inside surface of the orbiting wrap, being adjacent to the ejection hole and connected to the outer contact portion, and the compression chamber includes a first compression chamber formed when the outer contact portion contacts a first position of an inside surface of the fixed wrap at an ejection starting time of the refrigerant, and the outer contact portion is connected to the inner contact portion along a circumference of a first center circle formed to contact the first position at the ejection starting time of the refrigerant, and a center of the first center circle is placed on a normal line of the first position.

21 Claims, 14 Drawing Sheets

SCROLL COMPRESSOR

CROSS-REFERENCE TO RELATED APPLICATIONS

This application claims the benefit of Korean Patent Application No. P2014-8237, filed on Jan. 23, 2014 in the Korean Intellectual Property Office, the disclosure of which is incorporated herein by reference.

BACKGROUND

1. Field

One or more embodiments of the present disclosure relate to a scroll compressor, and more particularly, to a scroll compressor having an improved structure in which reliability of a compression portion can be enhanced.

2. Description of the Related Art

A scroll compressor is an apparatus that compresses a refrigerant by a relative movement obtained by combining a fixed scroll and an orbiting scroll each having a wrap in a spiral shape. The scroll compressor has high efficiency compared to a reciprocating compressor or a rotary compressor, has low vibration and noise, and can be made small and light-weight and thus is widely used in a refrigerating cycle device.

The scroll compressor has a compression chamber formed by the fixed scroll accommodated in a sealed container and the orbiting scroll that faces the fixed scroll and orbits. The compression chamber is tapered from an outer circumferential side toward an inner circumferential side of the compression chamber by rotation of the orbiting scroll. The refrigerant is absorbed from the outer circumferential side of the compression chamber, is compressed and is ejected into the sealed container from a central portion of the compression chamber.

Since the refrigerant needs to be gradually compressed by the scroll compressor as the refrigerant gets closer to the inner circumferential side from the outer circumferential side of the compression chamber, the wraps of the orbiting scroll and the fixed scroll need to be designed so that they can closely contact each other at an appropriate position.

In general, the wraps of the orbiting scroll and the fixed scroll of the scroll compressor may have an involute shape that is capable of being designed from a virtual design reference as a basic circle. However, the involute-shaped wraps have a limitation in maintaining high efficiency of a compressor and in making a relatively small compressor. That is, in order to increase a capacity of the scroll compressor, the size of the scroll compressor need to be increased, or heights of the wraps formed on the orbiting scroll and the fixed scroll need to be increased. However, this is contrary to a trend of making a relatively small compressor. Also, when the heights of the wraps formed on the orbiting scroll and the fixed scroll are increased, pressure generated by compressing the refrigerant results in an action point that increases by the increased heights of the wraps. Thus, a whole moment to be applied to the wraps increases, which may cause a decrease in reliability.

In order to solve the problem, the orbiting scroll and the fixed scroll that constitute the scroll compressor may be designed to have algebraic spiral wraps, of which thickness increases from the outer circumferential side toward the inner circumferential side of the compression chamber.

The scroll compressor having the algebraic spiral wraps is designed based on a designer's experience, because it is difficult to set the design reference, such as the basic circle.

Thus, ends of the wraps may have a cuspate or cusp shape, which may cause lowering of reliability of the compression chamber and a processing load.

SUMMARY

Therefore, it is an aspect of the present disclosure to provide a scroll compressor having an improved structure in which a compression capacity of a compression portion can be increased.

It is another aspect of the present disclosure to provide a scroll compressor having an improved structure in which a load caused by increasing a compression capacity of a compression portion can be prevented.

Additional aspects of the disclosure will be set forth in part in the description which follows and, in part, will be obvious from the description, or may be learned by practice of the disclosure.

In accordance with an aspect of the present disclosure, a scroll compressor includes a compression unit that compresses a refrigerant introduced into a body, wherein the compression unit may include: a fixed scroll fixed into the body and having an ejection hole and a fixed wrap placed at an outside of the ejection hole; and an orbiting scroll orbiting with respect to the fixed scroll and having an orbiting wrap that constitutes a compression chamber together with the fixed wrap, and wherein the orbiting wrap may include: an outer contact portion formed at an outside surface of the orbiting wrap and being adjacent to the ejection hole; and an inner contact portion formed at an inside surface of the orbiting wrap, being adjacent to the ejection hole and connected to the outer contact portion, and the compression chamber may include a first compression chamber formed when the outer contact portion contacts a first position of an inside surface of the fixed wrap at an ejection starting time of the refrigerant, and the outer contact portion may be connected to the inner contact portion along a circumference of a first center circle formed to contact the first position at the ejection starting time of the refrigerant, and a center of the first center circle may be placed on a normal line of the first position.

The fixed wrap may include: an outer contact portion formed at an outside surface of the fixed wrap and being adjacent to the ejection hole; and an inner contact portion formed at an inside surface of the fixed wrap, being adjacent to the ejection hole and connected to the outer contact portion, and the compression chamber may further include a second compression chamber formed when the outer contact portion contacts a second position of an inside surface of the orbiting wrap at the ejection starting time of the refrigerant.

The first center circle may meet with a first correspondence circle that contacts the second position at the ejection starting time of the refrigerant.

The first center circle may contact the first correspondence circle and may constitute one contact point.

The outer contact portion may be placed on the circumference of the first center circle, and the inner contact portion may be placed on a circumference of the first correspondence circle.

The orbiting wrap may further include a connection portion that passes through the contact point and connects the outer contact portion and the inner contact portion, and the connection portion may include: a first section that connects the outer contact portion and the contact point along the circumference of the first center circle; and a second section that connects the inner contact portion and the contact point along the circumference of the first correspondence circle.

The contact point may be an inflection point.

The first center circle and the first correspondence circle may have different diameters.

The normal line of the first position may meet with a tangential line of the second position in a third position, and diameters of the first center circle and the first correspondence circle may be less than a separation degree of the first position and the third position.

The outer contact portion may be connected to the inner contact portion along a circumference of a second center circle formed to contact the second position at the ejection starting time of the refrigerant, and a center of the second center circle may be placed on a normal line of the second position.

The second center circle may constitute one contact point with a second correspondence circle that contacts the first position at the ejection starting time of the refrigerant, and the contact point may be an inflection point.

The outer contact portion may be placed on the circumference of the second center circle, and the inner contact portion may be placed on a circumference of the second correspondence circle.

The fixed wrap may further include a connection portion that passes through the contact point and connects the outer contact portion and the inner contact portion, and the connection portion may include: a first connection section that connects the outer contact portion and the contact point along the circumference of the second center circle; and a second connection section that connects the inner contact portion and the contact point along the circumference of the second correspondence circle.

The normal line of the second position may meet with a tangential line of the first position in a fourth position, and diameters of the second center circle and the second correspondence circle may be less than a separation degree of the second position and the fourth position.

The fixed wrap and the orbiting wrap may be configured of points that satisfy the following equation:

$$\vec{M} = a\phi^k \cdot e^{j\phi},$$

where a and k are constants and $\phi$ is an angle between the X-axis and $$\vec{M},$$

so that the fixed wrap and the orbiting wrap have spiral shapes.

In accordance with another aspect of the present disclosure, a scroll compressor includes: a body in which oil is accommodated; an upper flange fixed to the body; a fixed scroll fixed to the body so as to be placed at an upper side of the upper flange and having a fixed wrap in a spiral shape; an orbiting scroll orbiting with respect to the fixed scroll and having an orbiting wrap that is coupled to the fixed wrap and constitutes a compression chamber; a rotation shaft which is coupled to the orbiting scroll so as to transfer a rotational force of a driving unit provided in the body and in which an oil movement pipe through which the oil moves, is formed; and an Oldham's ring accommodated in an Oldham's ring accommodation portion provided between the upper flange and the orbiting scroll and preventing rotation of the orbiting scroll, wherein the orbiting scroll may include an oil supply portion formed at an outside of the orbiting wrap so that the oil can be transferred to the Oldham's ring.

The oil supply portion may include a shape of a hole or a shape of a slit that faces an outward direction of the orbiting wrap.

The orbiting scroll may further include an orbiting plate which supports the orbiting wrap and in which an oil movement path connected to the oil movement pipe is provided.

The fixed scroll may include: a body in which a fixed wrap is accommodated; and a fixed plate that protrudes from the body in an outward direction of the body and has a contact portion contacting the orbiting plate, and an oil groove may be formed in the contact portion along a circumference of the fixed wrap.

An oil supply hole that is moved integrally with the orbiting scroll may be formed in one end of the oil movement path so that the oil can pass through the oil movement path and can be transferred to the contact portion, and the oil may be selectively supplied to the oil groove via the oil supply hole.

The oil supply portion may be moved integrally with the orbiting scroll, and the oil supply portion may selectively meet with the oil groove so that the oil supplied to the oil groove via the oil supply hole can be selectively transferred to the Oldham's ring via the oil supply portion.

The oil supply portion may be placed on the oil groove together with the oil supply hole according to an orbiting motion of the orbiting scroll.

The oil supply portion may be formed through the orbiting plate so that one end of the oil supply portion faces the contact portion and the other end of the oil supply portion faces the Oldham's ring accommodation portion.

In accordance with still another aspect of the present disclosure, a scroll compressor includes a compression unit that compresses a refrigerant introduced into a body, wherein the compression unit may include: a fixed scroll fixed into the body and having an ejection hole and a fixed wrap placed at an outside of the ejection hole; and an orbiting scroll orbiting with respect to the fixed scroll and having an orbiting wrap that is coupled to the fixed wrap and constitutes a compression chamber, and wherein the orbiting wrap may include: an outer contact portion formed at an outside surface of the orbiting wrap and being adjacent to the ejection hole; and an inner contact portion formed at an inside surface of the orbiting wrap, being adjacent to the ejection hole; and a connection portion that connects the outer contact portion and the inner contact portion, and the connection portion is placed on a circumference of a center circle contacting the outer contact portion and a circumference of a correspondence circle contacting the center circle.

A center of the center circle may be placed inside the outside surface, and a center of the correspondence circle may be placed inside the inside surface.

The center circle and the correspondence circle may constitute a contact point, and the connection portion may include: a first section that connects the outer contact portion and the contact point; and a second section that connects the inner contact portion and the contact point, and the first section may be placed on the circumference of the center circle, and the second section may be placed on the circumference of the correspondence circle.

In accordance with another aspect of the present disclosure, a compression unit is configured to compress a refrigerant introduced into a body of a scroll compressor. The compression unit includes a fixed scroll configured to be disposed in the body and having an ejection hole and a fixed wrap placed at an outside of the ejection hole, and an orbiting scroll orbiting with respect to the fixed scroll and having an orbiting wrap that is coupled to the fixed wrap and constitutes a compression chamber. The orbiting wrap includes an outer contact portion formed at an outside surface of the orbiting wrap and being adjacent to the ejection hole, an inner contact portion formed at an inside surface of the orbiting wrap and being adjacent to the ejection hole, and a connection portion that connects the outer contact portion and the inner contact portion, wherein the connection portion is placed on a circumference of a center circle contacting the outer contact portion and a circumference of a correspondence circle contacting the center circle.

In accordance with another aspect of the present disclosure a compression unit is configured to compress a refrigerant introduced into a body of a scroll compressor. The compression unit includes a fixed scroll configured to be disposed in the body and having an ejection hole and a fixed wrap placed at an outside of the ejection hole, and an orbiting scroll orbiting with respect to the fixed scroll and having an orbiting wrap that constitutes a compression chamber together with the fixed wrap. The orbiting wrap includes an outer contact portion formed at an outside surface of the orbiting wrap and being adjacent to the ejection hole, an inner contact portion formed at an inside surface of the orbiting wrap, the inner contact portion being adjacent to the ejection hole and connected to the outer contact portion. The compression chamber includes a first compression chamber formed when the outer contact portion contacts a first position of an inside surface of the fixed wrap at an ejection starting time of the refrigerant and the outer contact portion is connected to the inner contact portion along a circumference of a first center circle formed to contact the first position at the ejection starting time of the refrigerant.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
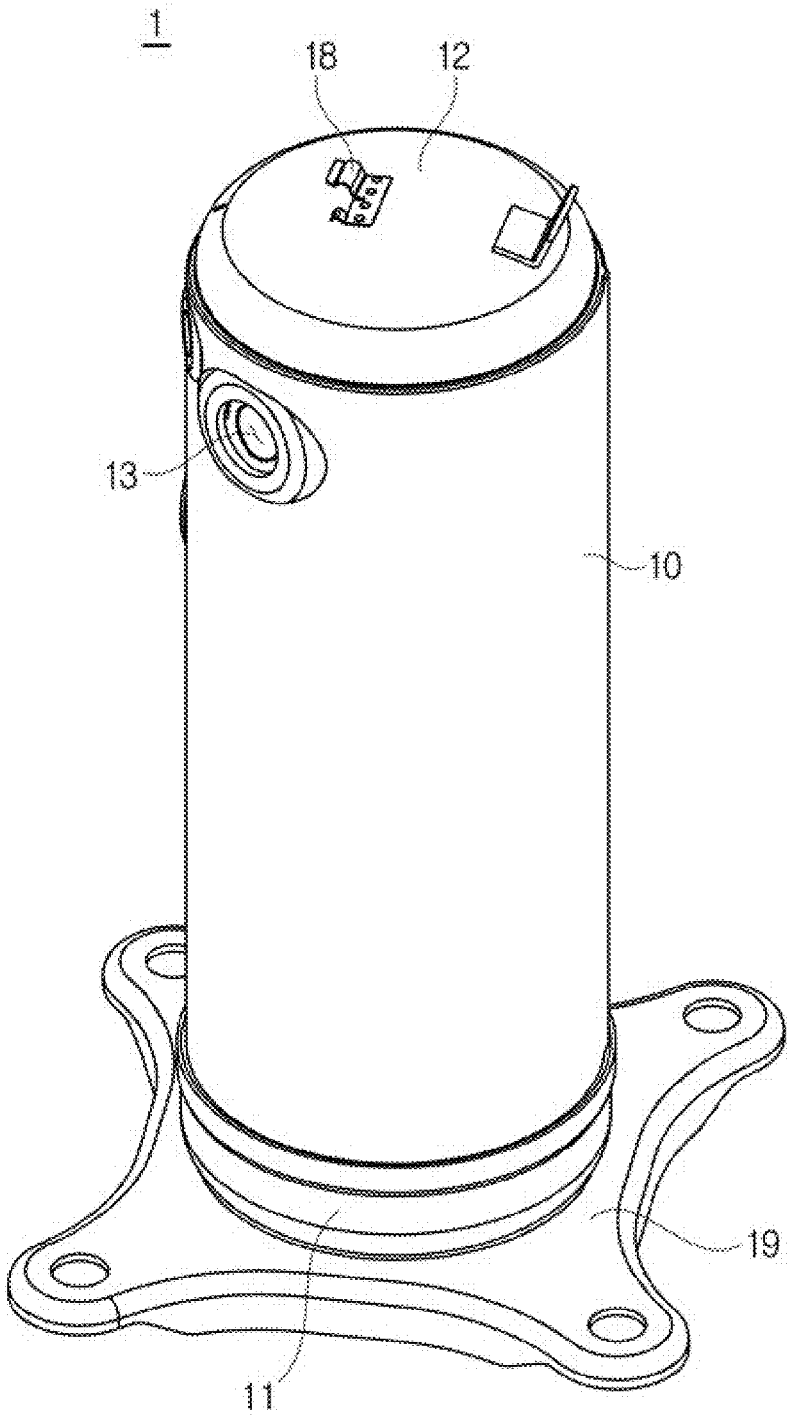
FIG. 1 is a perspective view of a scroll compressor in accordance with an embodiment of the present disclosure.

Reference will now be made in detail to the embodiments of the present disclosure, examples of which are illustrated in the accompanying drawings, wherein like reference numerals refer to like elements throughout. The terms used herein, such as a "front end," a "rear end," an "upper portion," a "lower portion," a "top end," and a "bottom end," are defined based on the drawings, and the shape and position of each element are not limited by the terms.

Figure 2:
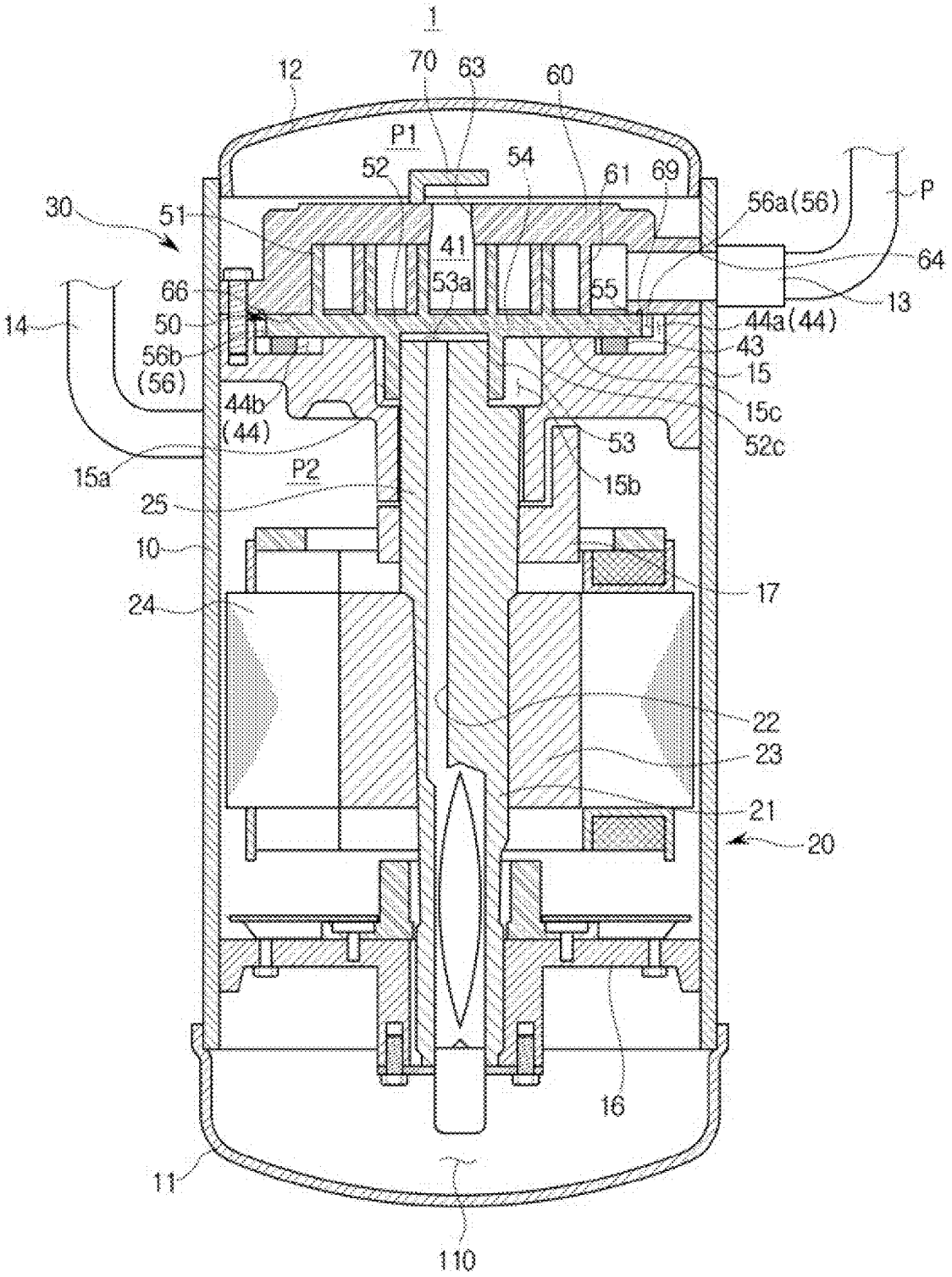
FIG. 2 is a cross-sectional view of the scroll compressor illustrated in FIG. 1.
Figure 3A:
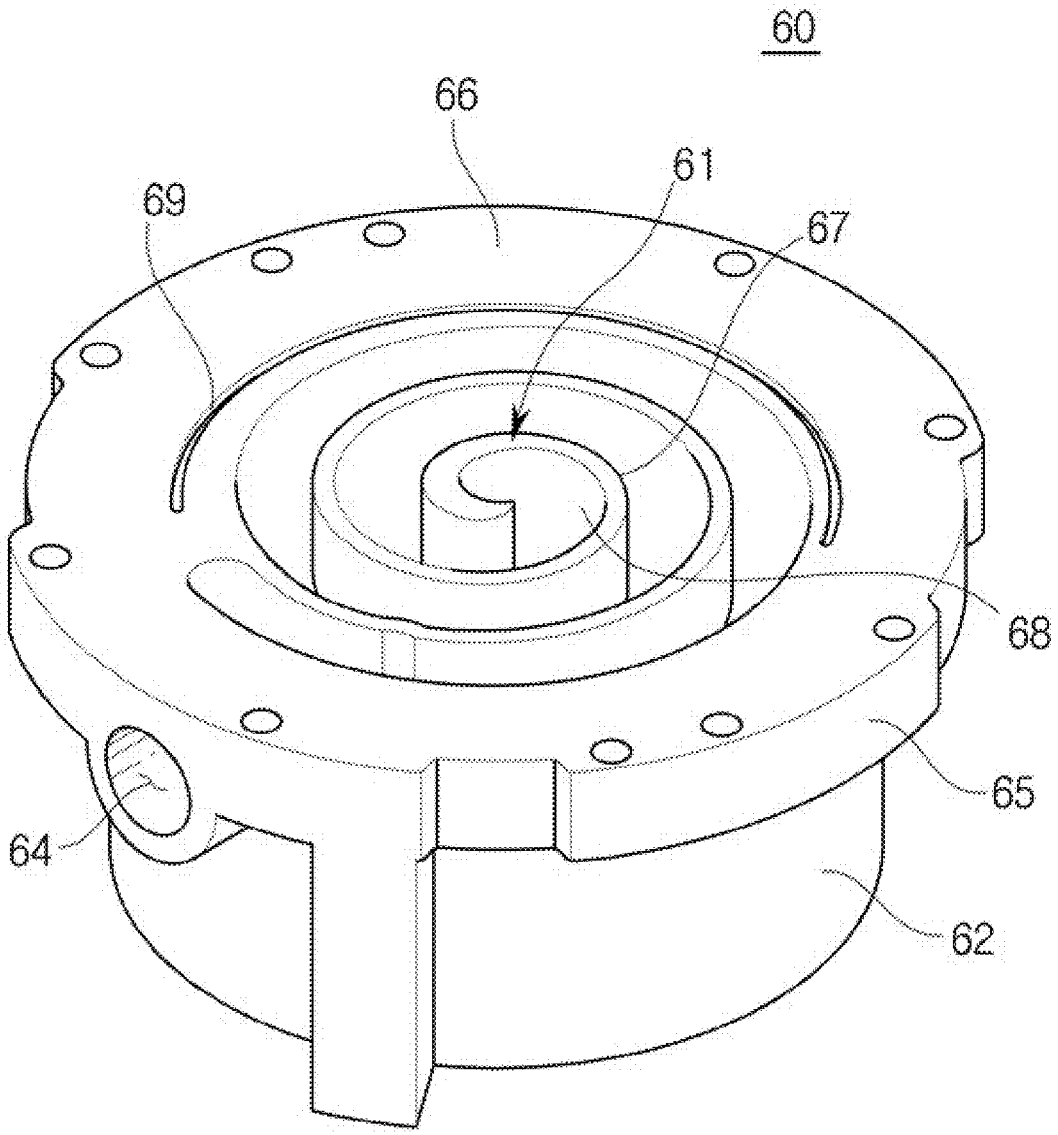
FIG. 3A is a perspective view of a fixed scroll of the scroll compressor of FIG. 1.
Figure 3B:
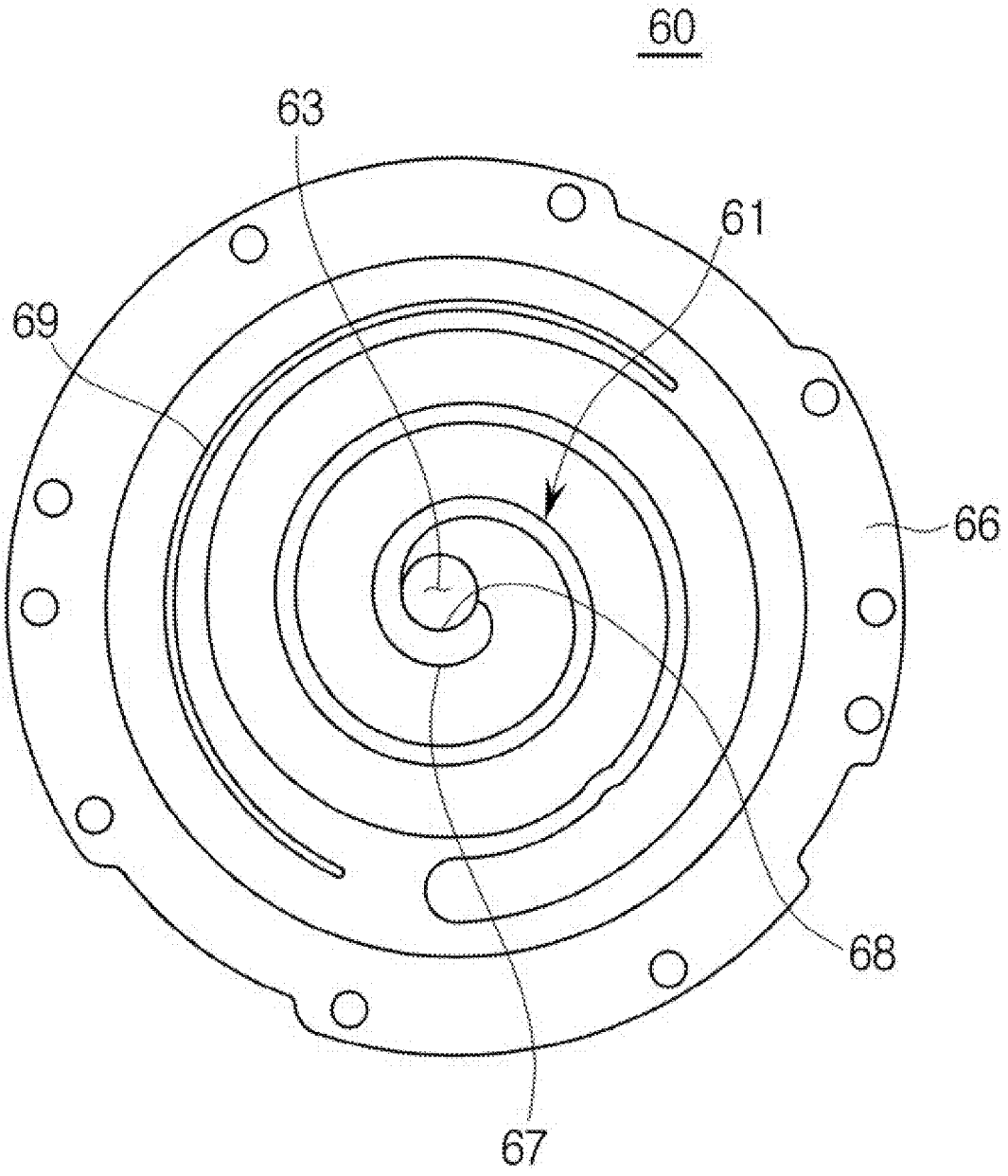
FIG. 3B is a plan view of the fixed scroll illustrated in FIG. 3A.
Figure 4A:
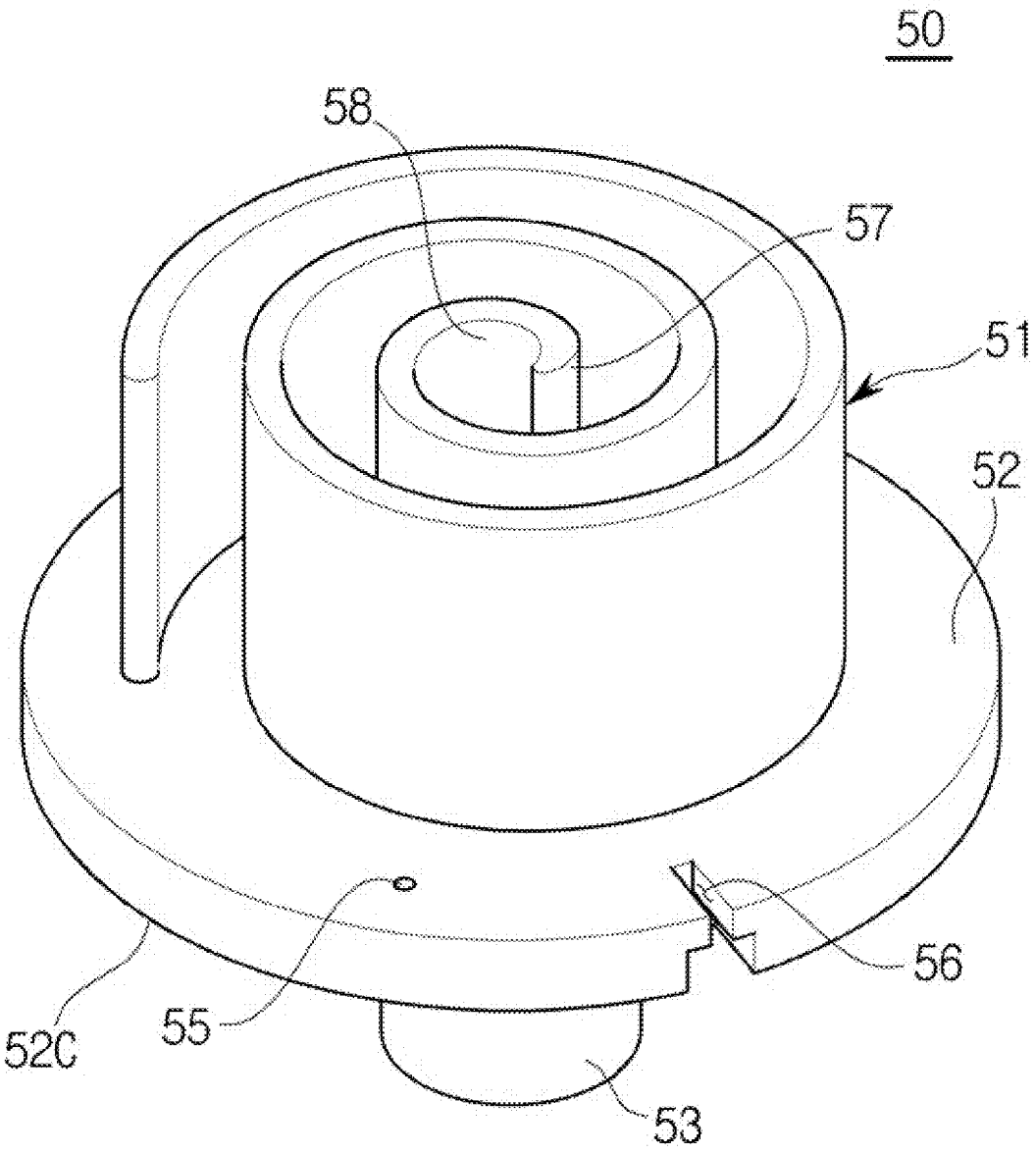
FIG. 4A is a perspective view of an orbiting scroll of the scroll compressor of FIG. 1, in accordance with an embodiment of the present disclosure.
Figure 4B:
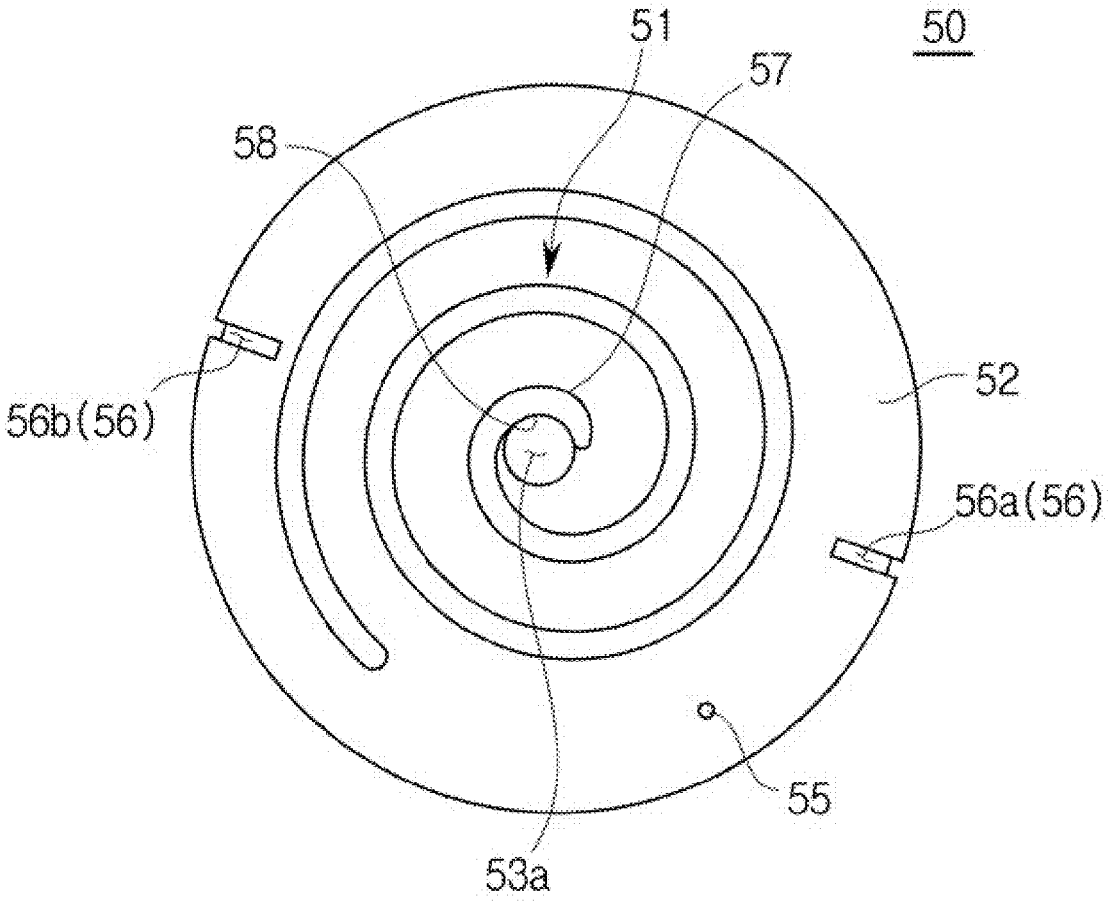
FIG. 4B is a plan view of the orbiting scroll illustrated in FIG. 4A.

FIG. 1 is a perspective view of a scroll compressor in accordance with an embodiment of the present disclosure, and FIG. 2 is a cross-sectional view of the scroll compressor illustrated in FIG. 1, and FIG. 3A is a perspective view of a fixed scroll of the scroll compressor of FIG. 1, and FIG. 3B is a plan view of the fixed scroll illustrated in FIG. 3A. FIG. 4A is a perspective view of an orbiting scroll of the scroll compressor of FIG. 1, in accordance with an embodiment of the present disclosure, and FIG. 4B is a plan view of the orbiting scroll illustrated in FIG. 4A.

As illustrated in FIGS. 1 through 4B, a scroll compressor 1 may include, for example, a body 10 having a sealed internal space, and a driving unit 20 and a compression unit 30 that are placed into the body 10. A fixing member 18 may be provided at an outside or exterior of the scroll compressor 1 and may be installed at and fixed to an outdoor unit of an air conditioner. Also, the scroll compressor 1 may further include a bottom plate 19 that is stably mounted on and fixed onto a bottom surface of the scroll compressor 1.

An inlet port 13 through which a refrigerant may be introduced into the scroll compressor 1, may be provided at one side of the body 10, and an ejection port 14, through which the refrigerant introduced through the inlet port 13 and then compressed may be ejected to the outside, may be provided at the other side of the body 10. An upper cap 12 and a lower cap 11 may be mounted on upper and lower portions of the body 10 so as to seal an inside of the body 10.

The driving unit 20 includes a stator 24 that is pressed in a lower side of the body 10 and a rotator 23 that is rotatably installed in a center of the stator 24. Balance weights 17 are installed at upper and lower portions of the rotator 23 so as to adjust rotation unbalance when the rotator 23 rotates.

An upper flange 15 and a lower flange 16 are fixed to upper and lower portions of an inside of the body 10. The driving unit 20 may be placed between the upper flange 15 and the lower flange 16. A rotation shaft 21 is mounted between the upper flange 15 and the lower flange 16 and transfers a rotational force generated from the driving unit 20 to an orbiting scroll 50 of the compression unit 30. An eccentric portion 25 is formed on a top end of the rotation shaft 21 so as to be eccentric from the center of the rotation shaft 21.

A through hole 15*a* through which the rotation shaft 21 passes and is installed, is formed in a center of the upper flange 15. An oil storing portion 15*b* in which oil to be sucked through the rotation shaft 21 is stored, may be formed around the through hole 15*a*. An oil movement pipe 22 may be installed in the rotation shaft 21 so as to pass through the rotation shaft 21 in an axial direction of the rotation shaft 21. An oil pump (not shown) may be installed on a bottom end of the oil movement pipe 22.

The compression unit 30 may include a fixed scroll 60 and the orbiting scroll 50 that makes a relative orbiting motion with respect to the fixed scroll 60, so as to compress the refrigerant introduced into the body 10. The fixed scroll 60 may be fixedly coupled to the body 10 so as to be placed at an upper side of the upper flange 15, and the orbiting scroll 50 may be placed between the fixed scroll 60 and the upper flange 15 so as to make an orbiting motion with respect to the fixed scroll 60. The orbiting scroll 50 is actuated by the rotation shaft 21 inserted into the orbiting scroll 50, and an orbiting wrap 51 having a spiral shape is formed on a top surface of the orbiting scroll 50. A fixed wrap 61 is formed on a bottom surface of the fixed scroll 60 so as to engage with the orbiting wrap 51 of the orbiting scroll 50. A detailed description of a structure of the orbiting scroll 50 and the fixed scroll 60 will be provided below.

The orbiting wrap 51 of the orbiting scroll 50 and the fixed wrap 61 of fixed scroll 60 are engaged with each other so that the orbiting scroll 50 and the fixed scroll 60 constitute a compression chamber 41. An Oldham's ring accommodation portion 44 may be provided between the orbiting scroll 50 and the upper flange 15. An Oldham's ring 43 may be accommodated in the Oldham's ring accommodation portion 44 so as to orbit the orbiting scroll 50 while preventing rotation of the orbiting scroll 50.

The inside of the body 10 is classified as an upper side portion P1 and a lower side portion P2 by the upper flange 15 and the fixed scroll 60, and the upper side portion P1 and the lower side portion P2 have high-pressure states. An inhalation port 64 through which a gas inhalation pipe P connected to the inlet port 13 communicates, is formed at one side of the fixed scroll 60, and an ejection hole 63 through which the refrigerant compressed in the compression chamber 41 is ejected to the upper side portion P1 of the body 10, is formed in the center of a top surface of the fixed scroll 60. In this case, a valve unit 70 that opens/closes the ejection hole 63 so as to prevent backflow of an ejected refrigerant gas, may be provided in the ejection hole 63.

If power is applied to the scroll compressor 1 having the following configuration, the rotation shaft 21 rotates together with the rotator 23, and the orbiting scroll 50 coupled to a top end of the rotation shaft 21 rotates. The orbiting scroll 50 orbits using an eccentricity distance that is a distance from the center of the rotation shaft 21 to the center of the eccentric portion 25 as an orbiting radius. In this case, rotation of the orbiting scroll 50 is prevented by the Oldham's ring 43.

As the orbiting scroll 50 orbits with respect to the fixed scroll 60, the compression chamber 41 is formed between the orbiting wrap 51 and the fixed wrap 61. The compression chamber 41 is moved to the center of the scroll compressor 1 due to a continuous orbiting motion of the orbiting scroll 50, and the volume of the compression chamber 41 is reduced so that the inhaled refrigerant can be compressed in the compression chamber 41.

The orbiting scroll 50 may include an orbiting plate 52 having a predetermined thickness and a predetermined area, the orbiting wrap 51 formed on a top surface of the orbiting plate 52 to have a predetermined thickness and a predetermined height, and a boss portion 53 formed on a bottom surface of the orbiting plate 52. The boss portion 53 may have a shape of a hollow portion 53*a*.

An oil movement path 54 connected to the oil movement pipe 22 may be provided inside the orbiting plate 52 that supports the orbiting wrap 51. In detail, an oil supply hole 55 that is moved integrally with the orbiting scroll 50 may be formed in one end of the oil movement path 54. The other end of the oil movement path 54 may face the hollow portion 53*a* of the boss portion 53 so as to be connected to the oil movement pipe 22.

The fixed scroll 60 may include a body 62 formed in a predetermined shape, the fixed wrap 61 formed in the body 62 to have a predetermined thickness and a predetermined height, the ejection hole 63 formed through the center of the body 62, and the inhalation port 64 formed at one side of the body 62.

The fixed scroll 60 may further include a fixed plate 65 that protrudes from the body 62 in an outward direction of the body 62 and has a contact portion 66 contacting the orbiting plate 52.

An oil groove 69 may be formed in the contact portion 66 along a circumference of the fixed wrap 61. The oil groove 69 may selectively communicate with the oil supply hole 55 according to an orbiting motion of the orbiting scroll 50. The oil groove 69 may have a recessed shape in which the oil that passes through the oil supply hole 55 may be accommodated.

An oil storing space 110 may be placed in a bottom surface of the inside of the body 10. A bottom end of the rotation shaft 21 extends to oil stored in the oil storing space 110 so that the oil stored in the oil storing space 110 can be moved in an upward direction via the oil movement pipe 22 formed in an axial direction of the rotation shaft 21.

The oil stored in the oil storing space 110 is pumped by an oil pump (not shown) installed at the bottom end of the rotation shaft 21 and is moved to a top end of the rotation shaft 21 along the oil movement pipe 22 formed in the rotation shaft 21. The oil that reaches the top end of the rotation shaft 21 may be accommodated in the oil storing portion 15*b*. As the boss portion 53 of the orbiting scroll 50 orbits in the oil storing portion 15*b*, the oil accommodated in the oil storing portion 15*b* is supplied between a bearing surface 52*c* of the orbiting plate 52 and a bearing surface 15*c* of the upper flange 15 and makes a lubrication action.

Also, part of the oil supplied to the bearing surface 52*c* of the orbiting plate 52 and the bearing surface 15*c* of the upper flange 15 is introduced into the compression chamber 41 formed by the orbiting wrap 51 of the orbiting scroll 50 and the fixed wrap 61 of the fixed scroll 60 via the oil supply hole 55 formed through the orbiting plate 52. The oil is supplied into the compression chamber 41 formed by the orbiting wrap 51 and the fixed wrap 61 so that a pressure leakage between the compression chamber 41 in a high pressure state and the compression chamber 41 in a low pressure state can be prevented. Also, excessive friction that occurs in the contact portion 66 of the orbiting scroll 50 and the fixed scroll 60 can be reduced.

Part of the oil introduced into the compression chamber 41 via the oil supply hole 55 formed through the orbiting plate 52 may be transferred to the Oldham's ring accommodation portion 44 so that an excessive load can be prevented from being applied to the Oldham's ring 43.

The orbiting scroll 50 may further include an oil supply portion 56 formed on the orbiting plate 52 so that the oil accommodated in the oil groove 69 via the oil supply hole 55 can be transferred to the Oldham's ring accommodation portion 44.

The oil supply portion 56 may be formed on the orbiting plate 52 so as to be placed at an outside of the orbiting wrap 51.

The oil supply portion 56 may have a shape of a slit. In detail, the oil supply portion 56 may have the shape of the slit that faces an outward direction of the orbiting wrap 51.

The oil supply portion 56 may be moved integrally with the orbiting scroll 50. Thus, the oil supply portion 56 may selectively meet with the oil groove 69 according to an orbiting motion of the orbiting scroll 50 and thus may selectively transfer the oil to the Oldham's ring accommodation portion 44.

The oil supply portion 56 may be formed on the orbiting plate 52 so as to be spaced apart from the oil supply hole 55 by a predetermined gap.

The oil supply portion 56 may be placed on the oil groove 69 together with the oil supply hole 55 according to the orbiting motion of the orbiting scroll 50.

The oil supply portion 56 may be formed through the orbiting plate 52 so that one end of the oil supply portion 56 may face the contact portion 66 and the other end of the oil supply portion 56 may face the Oldham's ring accommodation portion 44.

The orbiting scroll 50 may include at least one oil supply portion 56.

When the orbiting scroll 50 includes a plurality of oil supply portions 56, the plurality of oil supply portions 56 may be symmetrical with each other. However, embodiments of the present disclosure are not limited thereto.

A process of supplying the oil to the Oldham's ring accommodation portion 44 will be described below.

The oil that passes through the oil supply hole 55 via the oil movement path 54 is transferred to the contact portion 66. In detail, the oil that passes through the oil supply hole 55 is supplied into the oil groove 69 when the oil supply hole 55 is placed on the oil groove 69 according to the orbiting motion of the orbiting scroll 50. When the oil supply portion 56 and the oil groove 69 meet each other according to the orbiting motion of the orbiting scroll 50, the oil accommodated in the oil groove 69 passes through the oil supply portion 56 and is transferred to the Oldham's ring accommodation portion 44. That is, the oil is transferred to the Oldham's ring accommodation portion 44 when the oil groove 69, the oil supply portion 56, and the Oldham's ring accommodation portion 44 are placed in one straight line.

According to an embodiment, if it is assumed that the orbiting scroll 50 includes a first oil supply portion 56*a* and a second oil supply portion 56*b*, each of the oil supply portions 56*a* and 56*b* may alternately supply the oil into Oldham's ring accommodation portions 44*a* and 44*b*, respectively. The first oil supply portion 56*a* may be formed on the orbiting plate 52 so that one end of the first oil supply portion 56*a* may face a first Oldham's ring accommodation portion 44*a*, and the second oil supply portion 56*b* may be formed on the orbiting plate 52 so that one end of the second oil supply portion 56*b* may face a second Oldham's ring accommodation portion 44*b*. When the first oil supply portion 56*a* is placed on the oil groove 69 according to the orbiting motion of the orbiting scroll 50, the oil is supplied into the first Oldham's ring accommodation portion 44*a*, and when the second oil supply portion 56*b* is placed on the oil groove 69, the oil is supplied into the second Oldham's ring accommodation portion 44*b*.

Figure 5A:
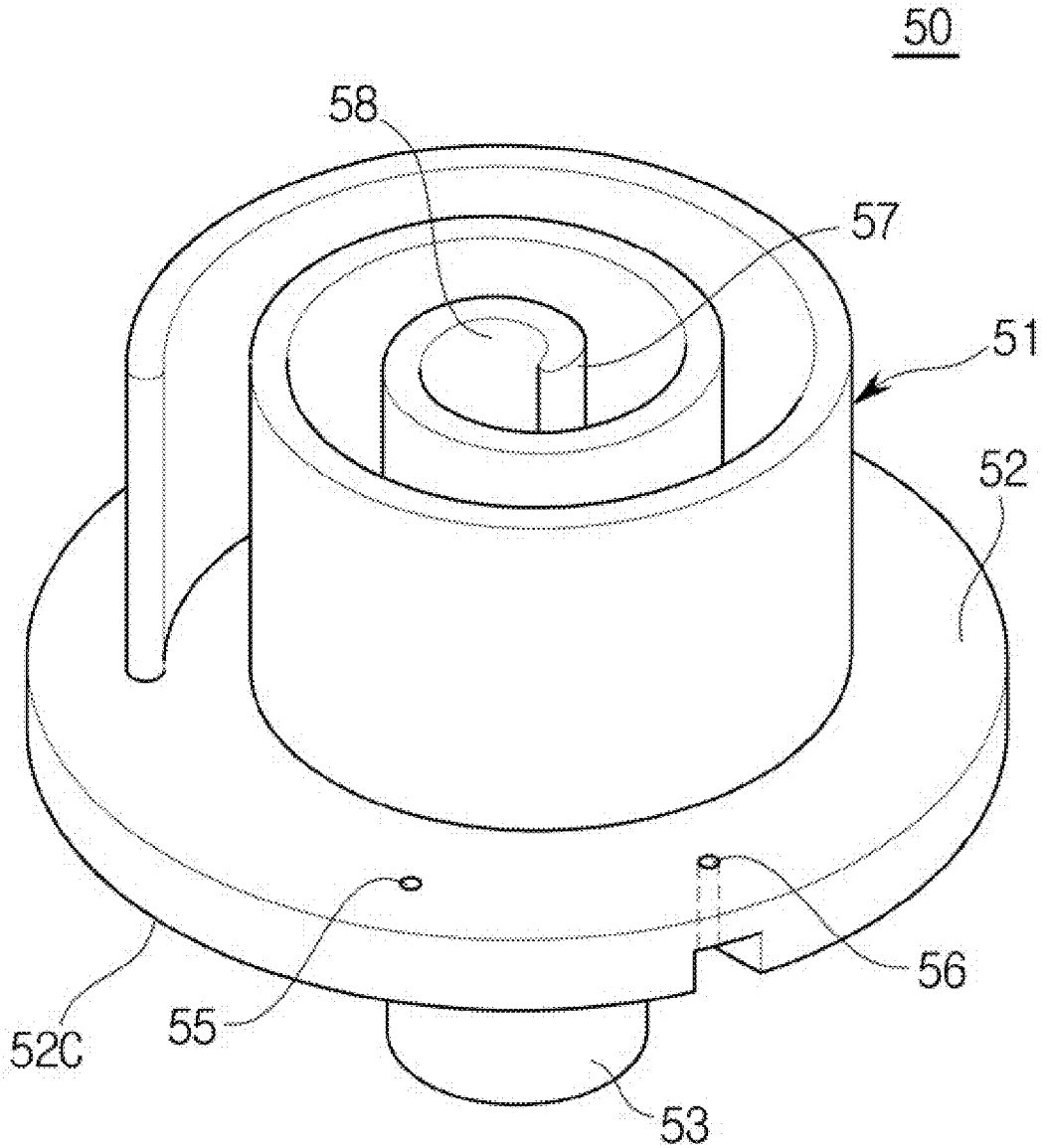
FIG. 5A is a perspective view of an orbiting scroll of the scroll compressor of FIG. 1, in accordance with another embodiment of the present disclosure.
Figure 5B:
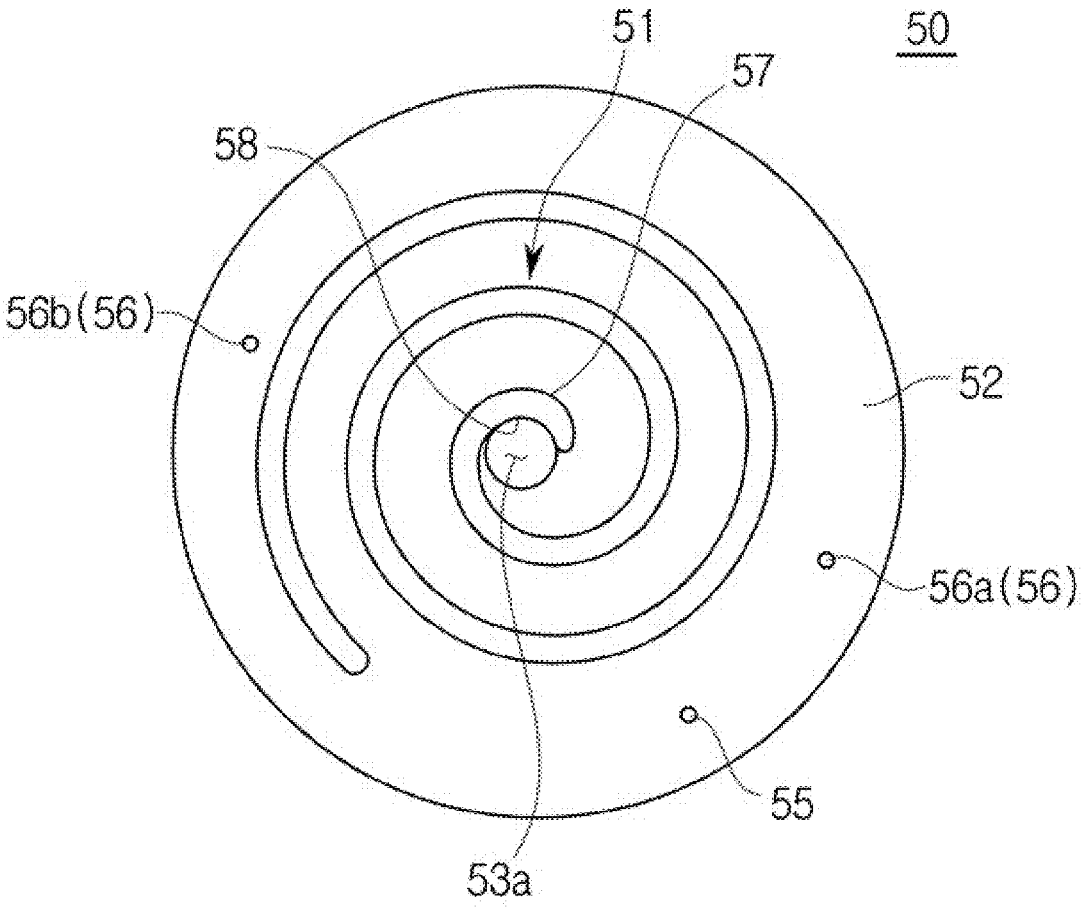
FIG. 5B is a plan view of the orbiting scroll illustrated in FIG. 5A.
Figure 6A:
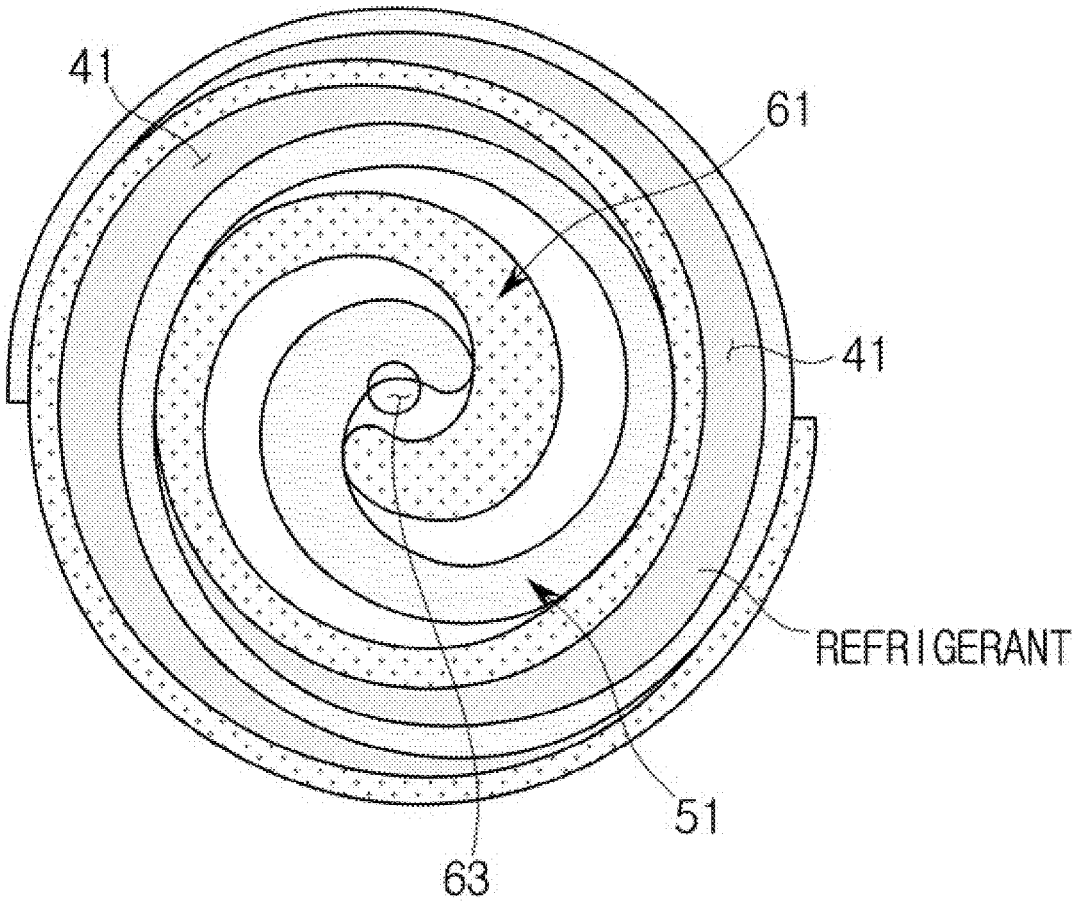
FIGS. 6A through 6D illustrate a process of compressing a refrigerant using the scroll compressor of FIG. 1.
Figure 6B:
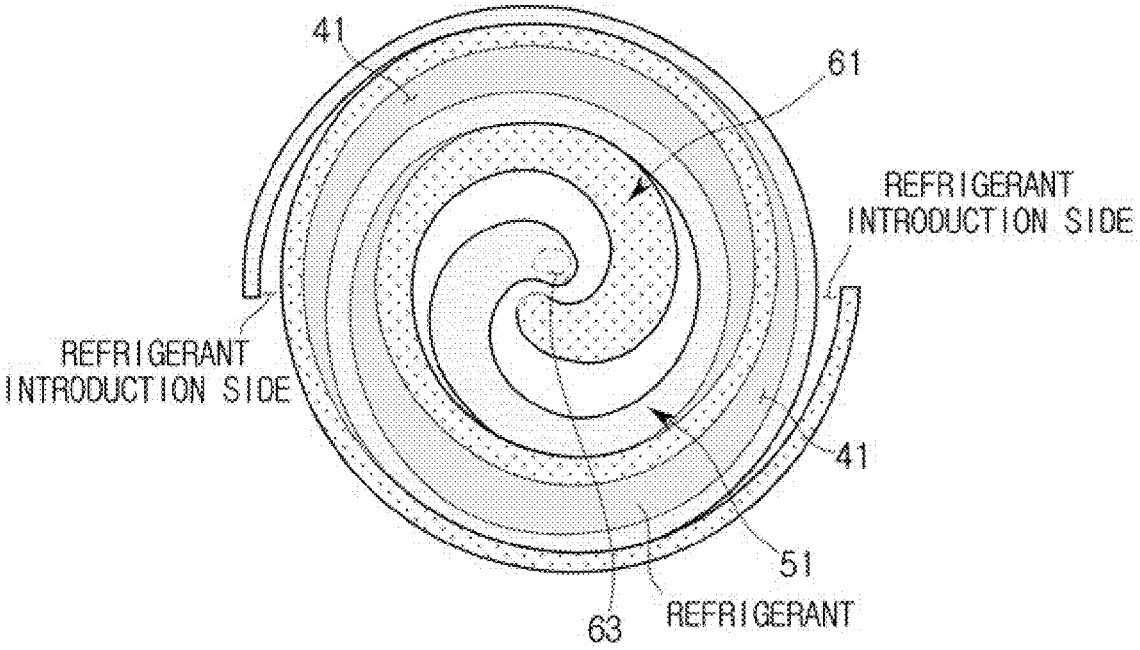
Figure 6C:
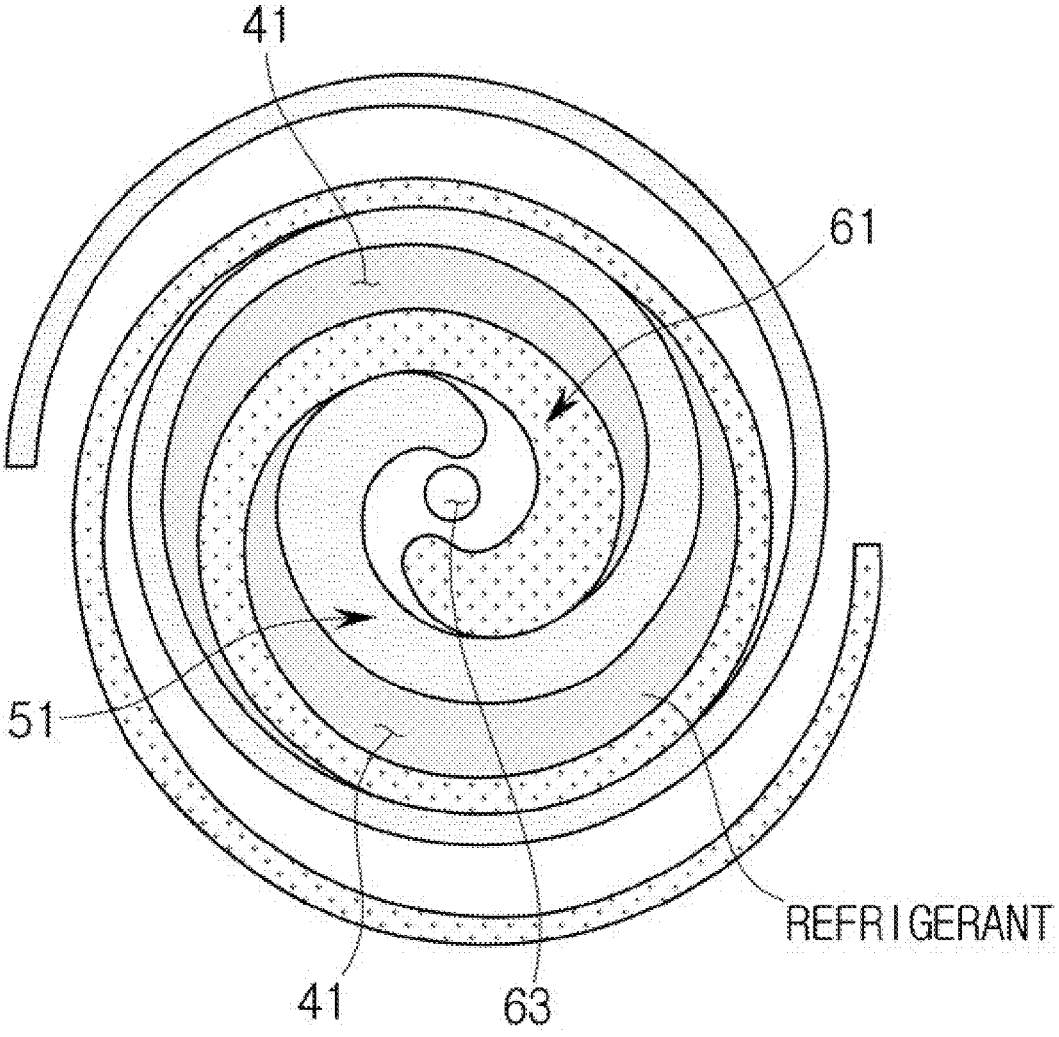
Figure 6D:
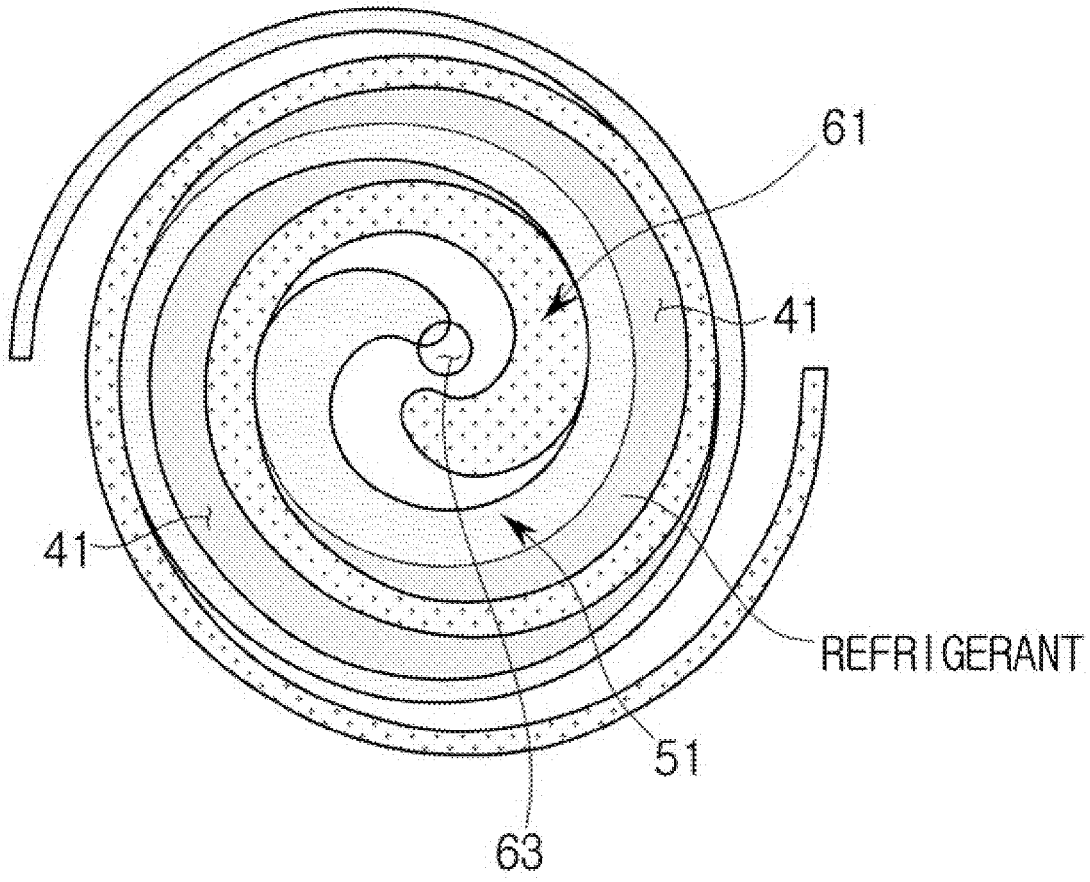

FIG. 5A is a perspective view of an orbiting scroll of the scroll compressor of FIG. 1, in accordance with another embodiment of the present disclosure, and FIG. 5B is a plan view of the orbiting scroll illustrated in FIG. 5A. Unillustrated reference numerals refer to FIGS. 1 through 4B. Hereinafter, any description redundant with the description of FIGS. 1 through 4B will be omitted.

As illustrated in FIGS. 5A and 5B, the oil supply portion 56 may further include a shape of a hole. The oil supply portion 56 may be placed at an outside of the orbiting wrap 51 so as to be spaced apart from the oil supply hole 55 by a predetermined gap.

The oil supply portion 56 and the oil supply hole 55 may be placed on a circumference of a virtual circle (not shown) that is drawn based on a center of the orbiting plate 52. That is, a distance between the center of the orbiting plate 52 and the oil supply portion 56 may be the same as a distance between the center of the orbiting plate 52 and the oil supply hole 55.

The oil supply portion 56 is not limited to a shape of a slit or hole and may have one of various shapes.

FIGS. 6A through 6D illustrate a process of compressing a refrigerant using the scroll compressor of FIG. 1. Unillustrated reference numerals refer to FIGS. 1 through 4B.

As illustrated in FIGS. 6A through 6D, if power is applied to the scroll compressor 1, the power is applied to the driving unit 20, and the driving unit 20 operates such as to rotate rotation shaft 21. If the rotation shaft 21 is rotated by a rotational force transmitted from the driving unit 20, the orbiting scroll 50 coupled to the eccentric portion 25 of the rotation shaft 21 orbits based on the rotation shaft 21. The Oldham's ring 43 prevents rotation of the orbiting scroll 50.

The orbiting scroll 50 orbits with respect to the fixed scroll 60 so that the orbiting wrap 51 and the fixed wrap 61 can be engaged with each other and constitute the compression chamber 41. The low-temperature low-pressure refrigerant introduced into the compression chamber 41 via the gas inhalation pipe P is moved to the center of the compression chamber 41 according to the orbiting motion of the orbiting scroll 50 and is compressed into a high-temperature high-pressure gaseous state. The compressed refrigerant is ejected to the upper side portion P1 of the body 10 via the ejection hole 63 of the fixed scroll 60 and is ejected to an outside of the scroll compressor 1 via the ejection port 14 provided at one side of the body 10.

The orbiting wrap 51 and the fixed wrap 61 may be coupled to each other and may constitute at least one compression chamber 41.

Figure 7:
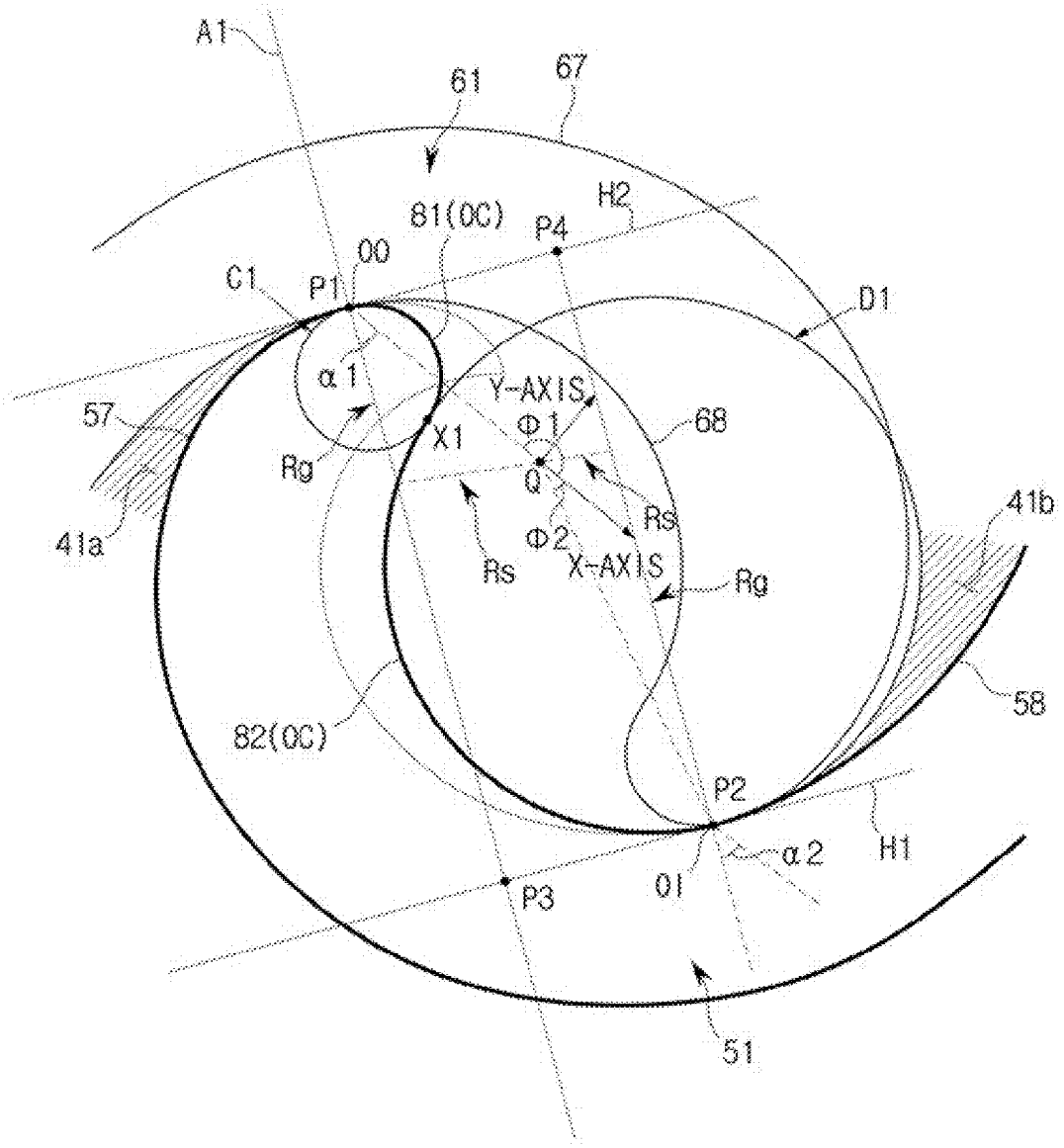
FIG. 7 is a state diagram illustrating a process of forming an orbiting wrap that constitutes the orbiting scroll of the scroll compressor of FIG. 1.

FIG. 7 is a state diagram illustrating a process of forming an orbiting wrap that constitutes the orbiting scroll of the scroll compressor of FIG. 1. FIG. 7 illustrates the relationship between the orbiting wrap 51 and the fixed wrap 61 at an ejection starting time T of the refrigerant. A normal line and a tangential line are perpendicular to each other. Unillustrated reference numerals refer to FIGS. 1 through 4B.

As illustrated in FIG. 7, the orbiting wrap 51 may include an outer contact portion OO, an inner contact portion OI, and a connection portion OC.

The outer contact portion OO is formed at an outside surface 57 of the orbiting wrap 51 so as to be adjacent to the ejection hole 63 formed in the fixed scroll 60, and the inner contact portion OI is formed at an inside surface 58 of the orbiting wrap 51 so as to be adjacent to the ejection hole 63. The connection portion OC connects the outer contact portion OO and the inner contact portion OI.

The outer contact portion OO contacts a first position P1 of an inside surface 68 of the fixed wrap 61 at the ejection starting time T of the refrigerant.

The connection portion OC connects the outer contact portion OO and the inner contact portion OI along a circumference of a first center circle C1 formed to contact the first position P1 at the ejection starting time T of the refrigerant.

A center of the first center circle C1 is placed on a normal line A1 of the first position P1.

The fixed wrap 61 includes an outer contact portion FO and an inner contact portion FI.

The outer contact portion FO is formed at an outside surface 67 of the fixed wrap 61 so as to be adjacent to the ejection hole 63, and the inner contact portion FI is formed at the inside surface 68 of the fixed wrap 61 so as to be adjacent to the ejection hole 63.

The outer contact portion FO contacts a second position P2 of the inside surface 58 of the orbiting wrap 51 at the ejection starting time T of the refrigerant.

The first center circle C1 may meet with a first correspondence circle D1 that contacts the second position P2 at the ejection starting time T of the refrigerant. Preferably, the first center circle C1 may contact the first correspondence circle D1 at the ejection starting time T of the refrigerant and may constitute one contact point X1.

The outer contact portion OO of the orbiting wrap 51 may be placed on the circumference of the first center circle C1, and the inner contact portion OI of the orbiting wrap 51 may be placed on a circumference of the first correspondence circle D1.

The connection portion OC of the orbiting wrap 51 may include a first section 81 and a second section 82. In detail, the first section 81 connects the outer contact portion OO and the contact point X1 along the circumference of the first center circle C1, and the second section 82 connects the inner contact portion OI and the contact point X1 along the circumference of the first correspondence circle D1.

The center of the first center circle C1 is placed inside the outside surface 57 of the orbiting wrap 51. The center of the first correspondence circle D1 is placed inside the inside surface 58 of the orbiting wrap 51.

The contact point X1 may be an inflection point.

The first center circle C1 and the first correspondence circle D1 may have different diameters. A diameter of the first center circle C1 may be greater or less than that of the first correspondence circle D1. However, embodiments of the present disclosure are not limited thereto, and the first center circle C1 and the first correspondence circle D1 may also have the same diameters.

The normal line A1 of the first position P1 meets with a tangential line H1 of the second position P2 in a third position P3. The normal line A1 of the first position P1 and the tangential line H1 of the second position P2 are perpendicular to each other.

A separation degree (distance) between the first position P1 and the third position P3 is greater than a diameter of the first center circle Cl and a diameter of the first correspondence circle D1. That is, the diameter of the first center circle C1 and the diameter of the first correspondence circle D1 are less than the separation degree between the first position P1 and the third position P3 so that rigidity of the compression unit 30 of the scroll compressor 1 can be secured. According to an exemplary embodiment, a first compression chamber is formed when the outer contact portion of the orbiting wrap contacts a first position P1 of an inside surface of the fixed wrap at an ejection starting time of the refrigerant, wherein the outer contact portion of the orbiting scroll is connected to the inner contact portion of the orbiting scroll along a circumference of a first center circle C1 formed to contact the first position P1 at the ejection starting time of the refrigerant, and wherein a center of the first center circle C1 is on a normal line of the first position P1, and a second compression chamber is formed when an outer contact portion of the fixed wrap contacts a second position P2 of an inside surface of the orbiting wrap at the ejection starting time of the refrigerant.

The connection portion OC that connects the outer contact portion OO and the inner contact portion OI of the orbiting wrap 51 is designed using the first center circle C1 and the first correspondence circle D1 so that cusps can be prevented from being formed at the connection portion OC.

The compression chamber 41 may include a first compression chamber 41*a* formed when the outer contact portion OO contacts the first position P1 of the inside surface 68 of the fixed wrap 61 at the ejection starting time T of the refrigerant. In detail, the first compression chamber 41*a* is formed to contact two points at which the outside surface 57 of the orbiting wrap 51 is spaced apart from the inside surface 68 of the fixed wrap 61 by a predetermined gap. The two points include the first position P1.

The orbiting wrap 51 may have a spiral shape that satisfies an equation $$\vec{M} = a\phi^k \cdot e^{i\phi}$$

(where a and k are constants and ϕ is an angle between the X-axis and $$\vec{M}).$$

That is, each spiral shape that constitutes the outside surface 57 and the inside surface 58 of the orbiting wrap 51 may satisfy an equation $$\vec{M} = a\phi^k \cdot e^{i\phi}$$

(where a and k are constants and ϕ is an angle between the X-axis and $$\vec{M}).$$

An arbitrary point M placed on the outside surface 57 and the inside surface 58 of the orbiting wrap 51 is defined as a position vector $$\vec{M}.$$

When the position vector $$\vec{M}$$

is decomposed into a normal line direction component $R_g$ and a tangential direction component $R_s$ and an equation $$\vec{M} = a\phi^k \cdot e^{j\phi}$$

is summarized as the normal line direction component $R_g$ and the tangential direction component $$R_s, \vec{M} = R_s \cdot e^{j\alpha} + R_g \cdot e^{j(\alpha+\pi/2)}$$

(where j is a constant and α is an ejection starting angle). The ejection starting angle α is an angle between the X-axis and the normal line direction component $R_g$.

In the orbiting wrap 51, an angle between the first position P1 on the outside surface 57 and the X-axis is ϕ1, and the ejection starting angle α in the first position P1 is α1. An angle between the second position P2 on the inside surface 58 and the X-axis is ϕ2, and the ejection starting angle α in the second position P2 is α2.

The outside surface 57 and the inside surface 58 of the orbiting wrap 51 may include an involute shape (where $R_g$ is a constant and $R_s$ is a variable) and an algebraic spiral shape (where $R_g$ and $R_s$ are variables).

As described above, in the ejection starting time T of the refrigerant, the outer contact portion OO of the orbiting wrap 51 contacts the first position P1, and the inner contact portion OI of the orbiting wrap 51 contacts the second position P2. The outer contact portion OO and the inner contact portion OI of the orbiting wrap 51 satisfy an equation $$\vec{M} = a\phi^k \cdot e^{j\phi}$$

(where a and k are constants and ϕ is an angle between the X-axis and $$\vec{M})$$

and an equation $$\vec{M} = R_s \cdot e^{j\alpha} + R_g \cdot e^{j(\alpha+\pi/2)}$$

(where j is a constant and α is an ejection starting angle) based on a starting point Q.

Figure 8:
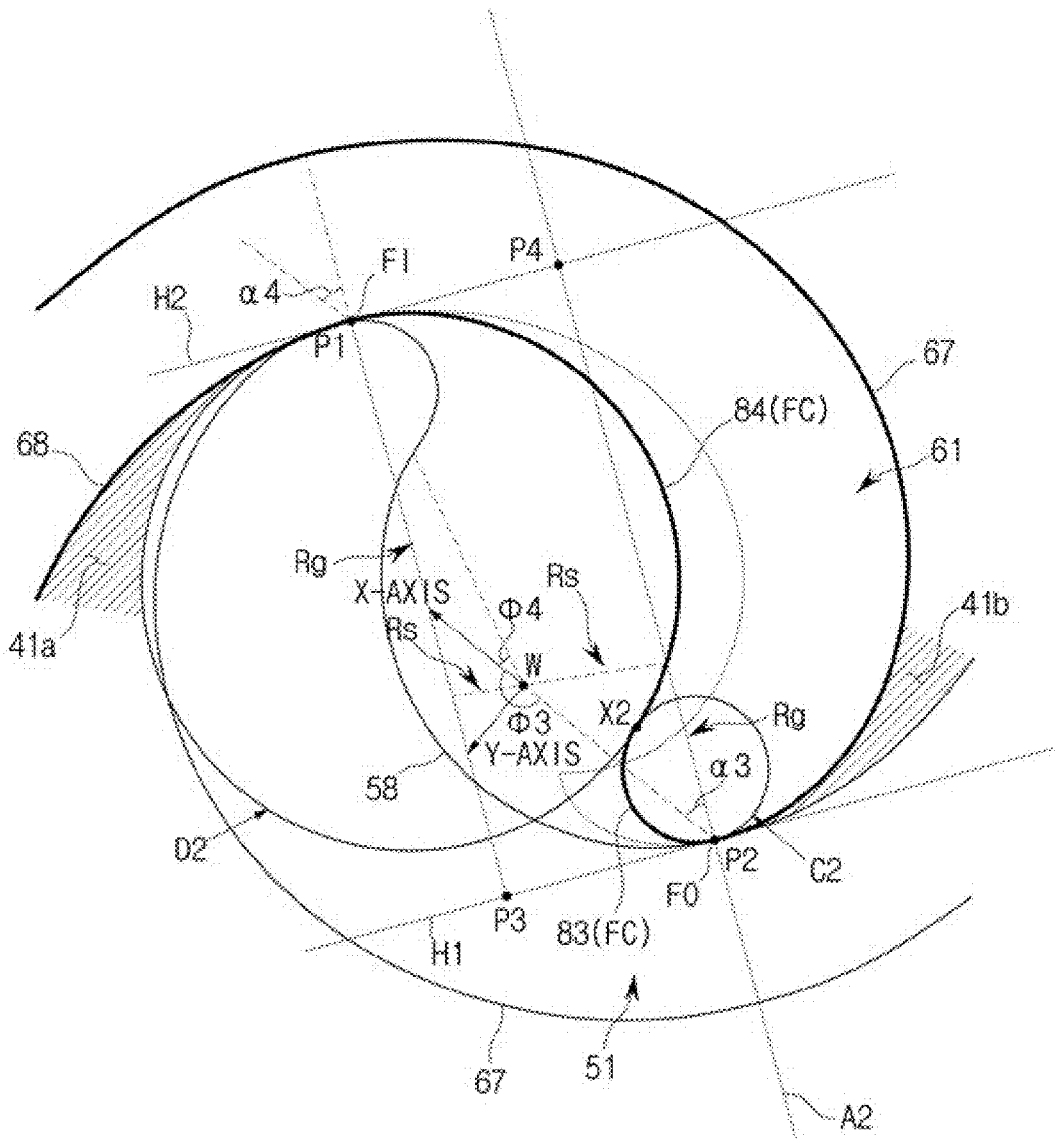
FIG. 8 is a state diagram illustrating a process of forming a fixed wrap that constitutes the fixed roll of the scroll compressor of FIG. 1.

FIG. 8 is a state diagram illustrating a process of forming a fixed wrap that constitutes the fixed roll of the scroll compressor of FIG. 1. FIG. 8 illustrates the relationship between the orbiting wrap 51 and the fixed wrap 61 at an ejection starting time T of the refrigerant. A normal line and a tangential line are perpendicular to each other. Unillustrated reference numerals refer to FIGS. 1 through 4B. Any description that is redundant with the description of FIGS. 1 through 7 will be omitted.

As illustrated in FIG. 8, the fixed wrap 61 of the fixed scroll 60 may further include a connection portion FC.

The connection portion FC of the fixed wrap 61 connects an outer contact portion FO and an inner contact portion FI.

The connection portion FC connects the outer contact portion FO and the inner contact portion FI along a circumference of a second center circle C2 formed to contact the second position P2 at the ejection starting time T of the refrigerant.

A center of the second center circle C2 is placed on a normal line A2 of the second position P2.

The second center circle C2 may meet with a second correspondence circle D2 that contacts the first position P1 at the ejection starting time T of the refrigerant. The second center circle C2 may contact the second correspondence circle D2 at the ejection starting time T of the refrigerant and may constitute one contact point X2. According to an exemplary embodiment, a normal line A1 of the first position P1 is separated by a distance greater than a diameter of the first center circle C1 from a normal line A2 of the second position P2.

The outer contact portion FO of the fixed wrap 61 is placed on the circumference of the second center circle 2, and the inner contact portion FI of the fixed wrap 61 may be placed on a circumference of the second correspondence circle D2.

The connection portion FC of the fixed wrap 61 may include a third section 83 and a fourth section 84. In detail, the third section 83 connects the outer contact portion FO and the contact point X2 along the circumference of the second center circle C2, and the fourth section 84 connects the inner contact portion FI and the contact point X2 along the circumference of the second correspondence circle D2.

The center of the second center circle C2 is placed inside the outside surface 67 of the fixed wrap 61. The center of the second correspondence circle D2 is placed inside the inside surface 68 of the fixed wrap 61.

The contact point X2 may be an inflection point.

The normal line A2 of the second position P2 meets with a tangential line H2 of the first position P1 in a fourth position P4. The normal line A2 of the second position P2 and the tangential line H2 of the first position P1 are perpendicular to each other.

Diameters of the second center circle C2 and the second correspondence circle D2 are less than a separation degree (distance) between the second position P2 and the fourth position P4.

The compression chamber 41 may further include a second compression chamber 41*b* formed when the outer contact portion FO contacts the second position P2 of the inside surface 58 of the orbiting wrap 51 at the ejection starting time T of the refrigerant. In detail, the second compression chamber 41*b* is formed to contact two points at which the exterior or outside surface 67 of the fixed wrap 61 is spaced apart from the inside surface 58 of the orbiting wrap 51 by a predetermined gap. The two points include the second position P2.

The fixed wrap 61 may have a spiral shape that satisfies an equation $$\vec{M} = a\phi^k \cdot e^{j\phi}$$

(where a and k are constants and ϕ is an angle between the X-axis and $$\vec{M}).$$

That is, each spiral shape that constitutes the outside surface 67 and the inside surface 68 of the fixed wrap 61 may satisfy an equation $$\vec{M} = a\phi^k \cdot e^{j\phi}$$

(where a and k are constants and $\phi$ is an angle between the X-axis and $$\vec{M}).$$

An arbitrary point M placed on the outside surface 67 and the inside surface 68 of the fixed wrap 61 is defined as a position vector $$\vec{M}.$$

As described above, in the ejection starting time T of the refrigerant, the outer contact portion FO of the fixed wrap 61 contacts the second position P2, and the inner contact portion FI of the fixed wrap 61 contacts the first position P1. The outer contact portion FO and the inner contact portion FI of the fixed wrap 61 satisfy an equation $$\vec{M} = a\phi^k \cdot e^{j\phi}$$

(where a and k are constants and $\phi$ is an angle between the X-axis and $$\vec{M})$$

and an equation $$\vec{M} = R_s \cdot e^{j\alpha} + R_g \cdot e^{j(\alpha+\pi/2)}$$

(where j is a constant and a is an ejection starting angle) based on a starting point W.

In the fixed wrap 61, an angle between the second position P2 on the outside surface 67 and the X-axis is $\phi$3, and the ejection starting angle $\alpha$ at the second position P2 is $\alpha$3. An angle between the first position P1 on the inside surface 68 and the X-axis is $\phi$4, and the ejection starting angle $\alpha$ in the first position P1 is $\alpha$4.

As described above, in one or more embodiments of the present disclosure a center circle and a correspondence circle are used so that cusps can be prevented from being formed on ends of a fixed wrap and an orbiting wrap that are adjacent to an ejection hole.

In one or more embodiments of the present disclosure, a sufficient amount of oil is supplied to a contact portion so that a pressure leakage between the fixed wrap and the orbiting wrap can be prevented and compression performance of a scroll compressor can be improved. Excessive friction between the fixed wrap and the orbiting wrap is prevented so that frequency of abrasion of the contact portion can be reduced.

In one or more embodiments of the present disclosure, the sufficient amount of oil is supplied to an Oldham's ring so that the Oldham's ring can be prevented from being worn out due to a load caused by increasing a compression capacity of a compression portion.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A compression unit configured to compress a refrigerant introduced into a body of a scroll compressor, the compression unit comprising:

a fixed scroll configured to be disposed in the body of the scroll compressor and having a discharge hole, the fixed scroll having a surface forming a fixed wrap; and an orbiting scroll orbitable with respect to the fixed scroll, the orbiting scroll having an orbiting wrap that is coupled to the fixed wrap and constitutes a compression chamber, and wherein the orbiting wrap comprises:

an outer contact portion formed at an outside surface of the orbiting wrap, the outer contact portion being adjacent to the discharge hole, an inner contact portion formed at an inside surface of the orbiting wrap, the inner contact portion being adjacent to the discharge hole, and a connection portion that connects the outer contact portion of the orbiting wrap and the inner contact portion of the orbiting wrap, wherein the connection portion is placed on a circumference of a center circle contacting the outer contact portion and a circumference of a correspondence circle contacting the center circle, the compression unit further comprising:

a first compression chamber formed when the outer contact portion of the orbiting wrap contacts a first position of an inside surface of the fixed wrap at a discharge starting time of the refrigerant, and a second compression chamber formed when an outer contact portion of the fixed wrap contacts a second position of an inside surface of the orbiting wrap at the discharge starting time of the refrigerant, wherein a normal line of the first position is separated by a distance greater than a diameter of the center circle from a normal line of the second position.

2. A compression unit configured to compress a refrigerant introduced into a body of a scroll compressor, the compression unit comprising:

a fixed scroll configured to be disposed in the body of the scroll compressor and having a discharge hole, the fixed scroll having a surface forming a fixed; and an orbiting scroll orbitable with respect to the fixed scroll, the orbiting scroll having an orbiting wrap that constitutes a compression chamber together with the fixed wrap, and wherein the orbiting wrap comprises:

an outer contact portion formed at an outside surface of the orbiting wrap, the outer contact portion being adjacent to the discharge hole, and an inner contact portion formed at an inside surface of the orbiting wrap, the inner contact portion being adjacent to the discharge hole and connected to the outer contact portion of the orbiting wrap, wherein the outer contact portion is connected to the inner contact portion of the orbiting scroll along a circumference of a first center circle formed to contact a first position at a discharge starting time of the refrigerant, the compression unit further comprising:

a first compression chamber formed when the outer contact portion of the orbiting wrap contacts the first position of an inside surface of the fixed wrap at the discharge starting time of the refrigerant, and a second compression chamber formed when an outer contact portion of the fixed wrap contacts a second position of an inside surface of the orbiting wrap at the discharge starting time of the refrigerant, and wherein a normal line of the first position is separated by a distance greater than a diameter of the first center circle from a normal line of the second position.

3. The compression unit of claim 2, wherein a center of the first center circle is placed on the normal line of the first position of the inside surface of the fixed wrap.

4. A scroll compressor comprising:

a compression unit that compresses a refrigerant introduced into a body of the scroll compressor, the compression unit including:

a fixed scroll fixed into the body and having a discharge hole, the fixed scroll having a surface forming a fixed wrap, and an orbiting scroll orbitable with respect to the fixed scroll, the orbiting scroll having an orbiting wrap that constitutes a compression chamber together with the fixed wrap, and wherein the orbiting wrap comprises:

an outer contact portion formed at an outside surface of the orbiting wrap, the outer contact portion being adjacent to the discharge hole of the fixed scroll, and an inner contact portion formed at an inside surface of the orbiting wrap, the inner contact portion being adjacent to the discharge hole of the fixed scroll and connected to the outer contact portion, wherein the compression chamber comprises:

a first compression chamber formed when the outer contact portion of the orbiting wrap contacts a first position of an inside surface of the fixed wrap at a discharge starting time of the refrigerant, wherein the outer contact portion of the orbiting scroll is connected to the inner contact portion of the orbiting scroll along a circumference of a first center circle formed to contact the first position at the discharge starting time of the refrigerant, and wherein a center of the first center circle is on a normal line of the first position, and a second compression chamber formed when an outer contact portion of the fixed wrap contacts a second position of an inside surface of the orbiting wrap at the discharge starting time of the refrigerant, wherein the normal line of the first position is separated by a distance greater than a diameter of the first center circle from a normal line of the second position.

5. The scroll compressor of claim 4, wherein the outer contact portion of the fixed wrap formed at an outside surface of the fixed wrap and being adjacent to the discharge hole, and the fixed wrap further comprising an inner contact portion formed at an inside surface of the fixed wrap and being adjacent to the discharge hole and connected to the outer contact portion.

6. The scroll compressor of claim 5, wherein the first center circle meets with a first correspondence circle that contacts the second position at the discharge starting time of the refrigerant.

7. The scroll compressor of claim 6, wherein the first center circle contacts the first correspondence circle and constitutes one contact point.

8. The scroll compressor of claim 7, wherein the outer contact portion is placed on the circumference of the first center circle, and the inner contact portion is placed on a circumference of the first correspondence circle.

9. The scroll compressor of claim 7, wherein the orbiting wrap further comprises a connection portion that passes through the contact point and connects the outer contact portion and the inner contact portion, and the connection portion comprises:

a first section that connects the outer contact portion and the contact point along the circumference of the first center circle; and a second section that connects the inner contact portion and the contact point along the circumference of the first correspondence circle.

10. The scroll compressor of claim 9, wherein the contact point is an inflection point.

11. The scroll compressor of claim 6, wherein the first center circle and the first correspondence circle have different diameters.

12. The scroll compressor of claim 6, wherein the normal line of the first position meets with a tangential line of the second position in a third position, and diameters of the first center circle and the first correspondence circle are less than a separation distance between of a location of the first position and a location of the third position.

13. The scroll compressor of claim 5, wherein the outer contact portion is connected to the inner contact portion along a circumference of a second center circle formed to contact the second position at the discharge starting time of the refrigerant, and a center of the second center circle is placed on the normal line of the second position.

14. The scroll compressor of claim 13, wherein the second center circle constitutes one contact point with a second correspondence circle that contacts the first position at the discharge starting time of the refrigerant, and wherein the contact point is an inflection point.

15. The scroll compressor of claim 14, wherein the outer contact portion is placed on the circumference of the second center circle, and the inner contact portion is placed on a circumference of the second correspondence circle.

16. The scroll compressor of claim 14, wherein the fixed wrap further comprises a connection portion that passes through the contact point and connects the outer contact portion and the inner contact portion, and the connection portion comprises:

a first connection section that connects the outer contact portion and the contact point along the circumference of the second center circle; and a second connection section that connects the inner contact portion and the contact point along the circumference of the second correspondence circle.

17. The scroll compressor of claim 14, wherein the normal line of the second position meets with a tangential line of the first position in a fourth position, and diameters of the second center circle and the second correspondence circle are less than a separation distance between a location of the second position and a location of the fourth position.

18. The scroll compressor of claim 1, wherein the fixed wrap and the orbiting wrap are configured of points that satisfy the following equation:

$$\vec{M} = a\phi^k \cdot e^{j\phi},$$

where a and k are constants and $\phi$ is an angle between the X-axis and $$\vec{M},$$

so that the fixed wrap and the orbiting wrap have spiral shapes.

19. A scroll compressor comprising:

a compression unit that compresses a refrigerant introduced into a body of the scroll compressor, the compression unit including:

a fixed scroll fixed into the body and having a discharge hole, the fixed scroll having a surface forming a fixed wrap, and an orbiting scroll orbitable with respect to the fixed scroll, the orbiting scroll having an orbiting wrap that is coupled to the fixed wrap and constitutes a compression chamber, and wherein the orbiting wrap comprises:

an outer contact portion formed at an outside surface of the orbiting wrap, the outer contact portion being adjacent to the discharge hole of the fixed scroll; and an inner contact portion formed at an inside surface of the orbiting wrap, the inner contact portion being adjacent to the discharge hole of the fixed scroll, and a connection portion that connects the outer contact portion of the orbiting wrap and the inner contact portion of the orbiting wrap, and is on a circumference of a center circle contacting the outer contact portion of the orbiting wrap and a circumference of a correspondence circle contacting the center circle, the compression unit further including:

a first compression chamber formed when the outer contact portion of the orbiting wrap contacts a first position of an inside surface of the fixed wrap at a discharge starting time of the refrigerant, and a second compression chamber formed when an outer contact portion of the fixed wrap contacts a second position of an inside surface of the orbiting wrap at the discharge starting time of the refrigerant, wherein a normal line of the first position is separated by a distance greater than a diameter of the center circle from a normal line of the second position.

20. The scroll compressor of claim 19, wherein a center of the center circle is placed inside the outside surface of the orbiting wrap, and a center of the correspondence circle is placed inside the inside surface of the orbiting wrap.

21. The scroll compressor of claim 19, wherein the center circle and the correspondence circle constitute a contact point, and the connection portion comprises:

a first section that connects the outer contact portion and the contact point; and a second section that connects the inner contact portion and the contact point, and the first section is placed on the circumference of the center circle, and the second section is placed on the circumference of the correspondence circle.

* * * * *